United States Patent [19]

Ohhashi et al.

[11] Patent Number: 4,902,058

[45] Date of Patent: Feb. 20, 1990

[54] DOOR LOCK

[75] Inventors: Masao Ohhashi, Kariya; Yoshimasa Ishiguro, Toyota, both of Japan

[73] Assignee: Aisin Seiki Kabushiki Kaisha, Japan

[21] Appl. No.: 285,444

[22] Filed: Dec. 16, 1988

[30] Foreign Application Priority Data

Dec. 17, 1987 [JP] Japan ..... 62-191567[U]

[51] Int. Cl.[4] ..... E05C 3/26

[52] U.S. Cl. ..... 292/337; 292/216; 292/346; 70/416

[58] Field of Search ..... 292/216, 280, 346, 337, 292/1; 70/416

[56] References Cited

U.S. PATENT DOCUMENTS

| | | | |
|---|---|---|---|
| 3,781,045 | 12/1973 | Watermann | 292/216 |
| 4,508,379 | 4/1985 | Machida | 292/346 X |
| 4,628,300 | 12/1986 | Amato | 292/346 X |

*Primary Examiner*—Richard E. Moore

*Attorney, Agent, or Firm*—Finnegan, Henderson, Farabow, Garrett & Dunner

[57] ABSTRACT

A door lock has an open lever linked with an open rod and pivotally mounted on a base plate and a locking lever linked with a locking link and pivotally mounted on a sub plate, the open lever and the locking lever being linked with each other through a locking rod so that a door is selectively locked and unlocked by the pivotal motion of the open lever which is caused by the pivotal motion of the locking lever. The door lock further has a protective wall in the shape of an upright wall which is formed integral with the side surface of the open lever which faces the locking lever. Since the protective wall which is formed integral with the open lever functions as a protective means, it is possible to reduce the number of parts and the number of man-hours needed for the assembling operation and further use the door lock in common to all types of vehicle.

1 Claim, 3 Drawing Sheets

DOOR LOCK

BACKGROUND OF THE INVENTION

1. Field of the Invention

The present invention relates to a door lock with a protective means which is designed to prevent theft of vehicles.

2. Description of the Related Art

A door lock with a protective means such as that shown in FIG. 4 has heretofore been known as a prior art related to the present invention.

In this prior art door lock, an open lever 14 which is linked with an open rod 3 is pivotally mounted on a base plate 1, while a locking lever 7 which is linked with a locking link 6 is pivotally mounted on a sub plate 2, and the open lever 14 and the locking lever 7 are linked with each other through a locking rod 10 so that the door is selectively locked and unlocked by the pivotal motion of the open lever 14 which is caused by the pivotal motion of the locking lever 7. The door lock is further provided with a protective member 12 which is rigidly secured to a sub base 11 which is in turn rigidly secured to the base plate 1 by the use of rivets 13 which are caulked after being inserted respectively through two pairs of bores provided in both the sub base 11 and the protective member 12, thus preventing the door from being unlocked from the outside of the vehicle by means of a special tool such as a wire.

The above-described prior art suffers, however, from the following disadvantages. Since the protective member in the prior art is produced as a constituent element which is separate from the door lock body, a sub base and rivets are needed to mount the protective member and this increases the number of parts and the number of man-hours required to assemble the door lock. Further, since the rivets must be caulked, it is necessary to provide an additional space for mounting the protective member. In addition, since that portion of the sub base on which the protective member is mounted sticks out from the outer periphery of the door lock body and the arrangement of peripheral parts which are provided inside the door depends on the type of vehicle, it is necessary to design a protective member for each type of vehicle.

SUMMARY OF THE INVENTION

In view of the above-described disadvantages of the prior art, it is a primary object of the present invention to provide a door lock which is so designed that it is possible to provide a protective means which is usable in common to all types of vehicle without an increase in the number of parts nor in the number of man-hours needed for the assembling operation.

To this end, the present invention provides a door lock having an open lever linked with an open rod and pivotally mounted on a base plate and a locking lever linked with a locking link and pivotally mounted on a sub plate, the open lever and the locking lever being linked with each other through a locking rod so that a door is selectively locked and unlocked by the pivotal motion of the open lever which is caused by the pivotal motion of the locking lever, wherein the improvement comprises a protective wall in the shape of an upright wall which is formed integral with the side surface of the open lever which faces the locking lever.

By virtue of the above-described arrangement, the protective wall that is formed integral with the open lever is capable of performing the same function as that of a protective member which has heretofore been provided as a separate element and there is therefore no need for such a protective member as well as a sub base and rivets which have heretofore been required to mount the protective member. Accordingly, it is possible to reduce the number of parts and the number of man-hours needed for the assembling operation and further use the door lock in common to all types of vehicle. Thus, it is possible to overcome the disadvantages of the prior art.

BRIEF DESCRIPTION OF THE DRAWINGS

The above and other objects, features and advantages of the present invention will become more apparent from the following description of a preferred embodiment thereof, taken in conjunction with the accompanying drawings, in which like reference numerals denote like elements and, of which:

FIG. 3(*b*) is a side view of the open lever; and

DESCRIPTION OF THE PREFERRED EMBODIMENT

One embodiment of the present invention will be described hereinunder in detail with reference to the accompanying drawings.

Figure 1:
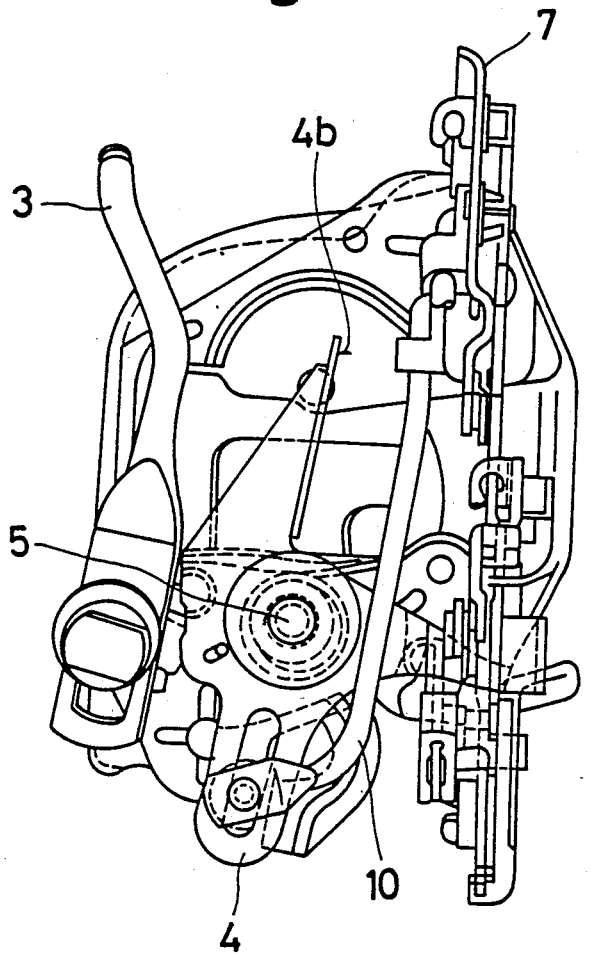
FIG. 1 is a front view of one embodiment of the door lock according to the present invention.
Figure 2:
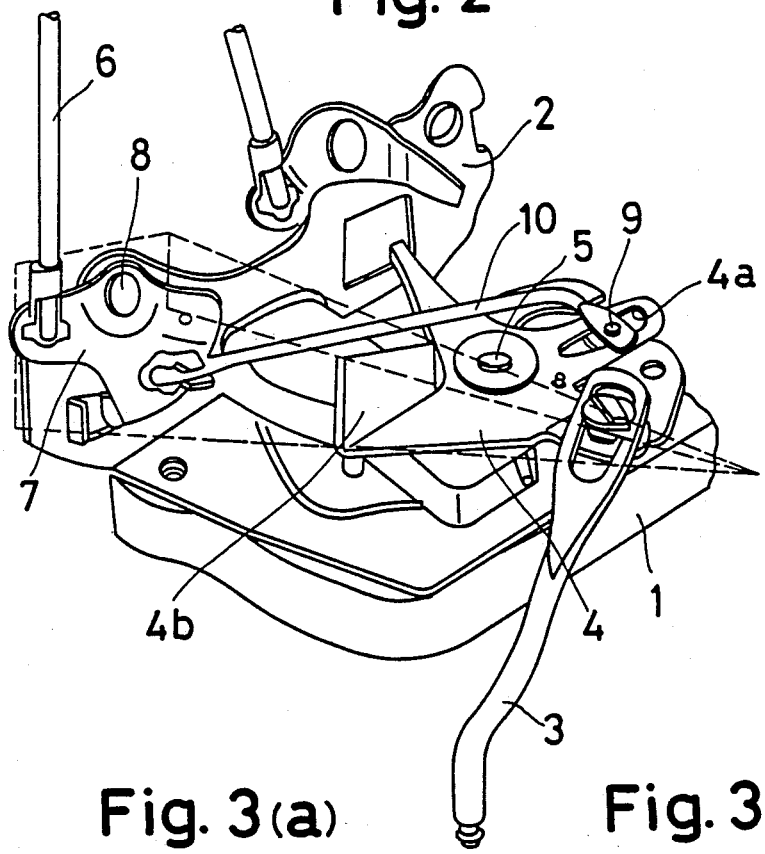
FIG. 2 is a perspective view of the door lock shown in FIG. 1.
Figure 3A:
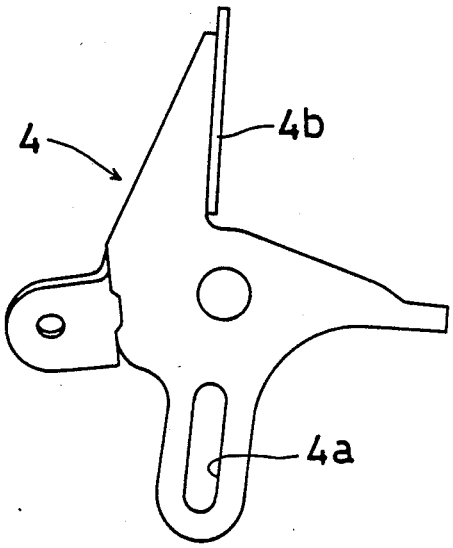
FIG. 3(*a*) is a front view of the open lever of the embodiment.
Figure 3B:
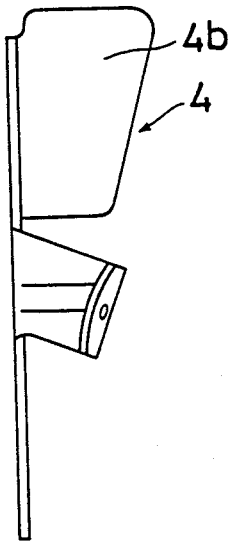
Figure 4:
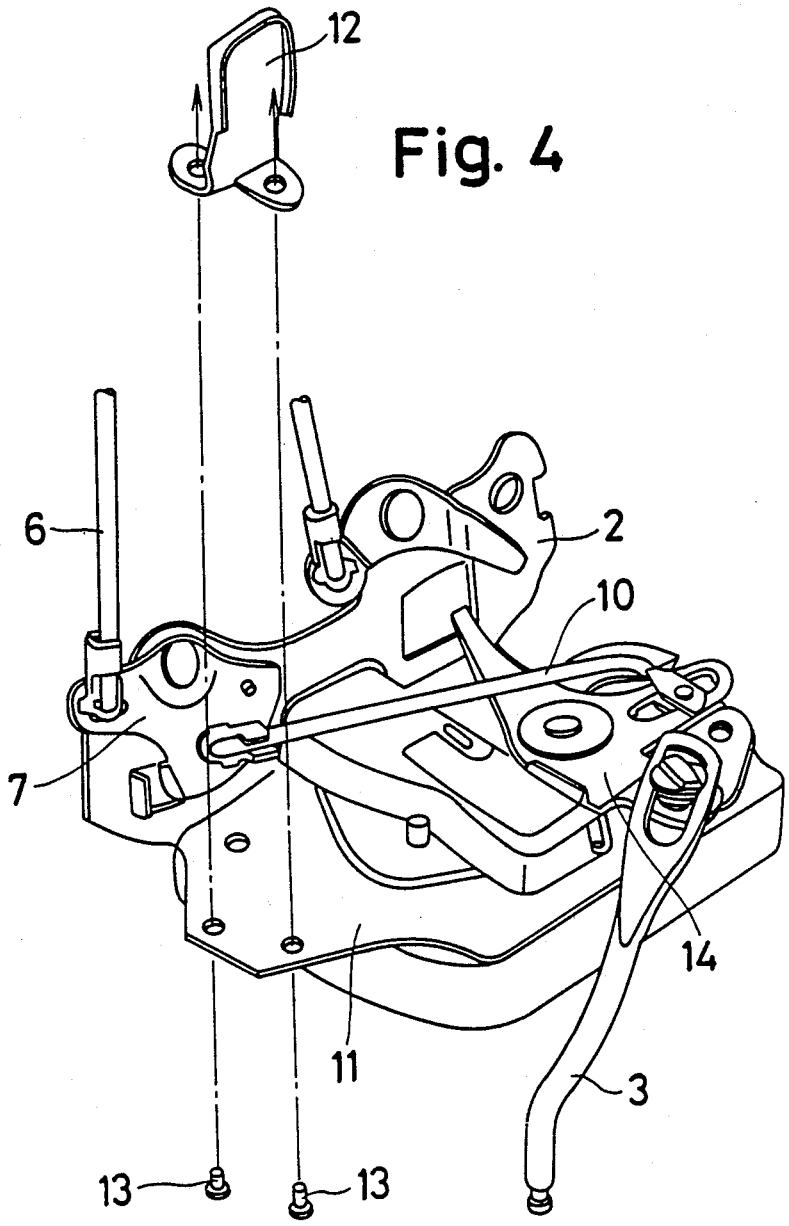
FIG. 4 is an exploded perspective view of a prior art.

Referring first to FIGS. 1 and 2, a base plate 1 is formed integral with a sub plate 2. An open lever 4 which is linked with one end of an open rod 3 is pivotally mounted on the base plate 1 through a pin 5, while a locking lever 7 is pivotally mounted on the sub plate 2 through a pin 8, the locking lever 7 having one end thereof rigidly secured to a locking link 6 which is linked with an indoor knob (not shown).

The open lever 4 is provided with a slot 4*a* for receiving a pin 9 which is engaged with one end of a locking rod 10. The other end of the locking rod 10 is rigidly secured to the locking lever 7. Thus, the open lever 4 is pivoted together with the locking lever 7 through the locking rod 10.

The open lever 4 has a protective wall 4*b* in the shape of an upright wall formed integral with the side surface thereof which faces the locking lever 7. The protective wall 4*b*, which replaces the conventional protective member for preventing theft, prevents an evil individual from pivoting the locking lever 7 by means of a special tool to unlock the door with criminal intent.

With the above-described arrangement, when the locking lever 7 is pivoted clockwise as viewed in FIG. 2 in response to the operation of either the indoor knob (not shown) or the key, the locking rod 10, together with the pin 9, is pulled leftward as viewed in FIG. 2. In consequence, the pin 9 comes into contact with the left-hand wall surface of the slot 4*a* in the open lever 4 and causes the open lever 4 to pivot counterclockwise, resulting in the door being locked. When the locking lever 7 is pivoted counterclockwise, the locking rod 10, together with the pin 5, moved rightward. In consequence, the pin 9 comes into contact with the right-hand wall surface of the slot 4*a* in the open lever 4 and causes the open lever 4 to pivot clockwise, resulting in the door being unlocked. The chain line shows in FIG. 2 represents an area within which the locking lever 7 is protected. More specifically, even if an evil individual tries to pivot the locking lever 7 with a special tool so as to unlock the door, the special tool is blocked by the protective wall 4*a* formed integral with the open lever 4 and thus the locking lever 7 is protected from being pivoted with the special tool. Accordingly, the protective wall 4*b* is capable of performing the same function as that of the conventional protective member, so that it is unnecessary to provide an additional protective member such as that in the prior art.

As has been described above, since a protective wall is formed integral with the open lever, it becomes unnecessary to employ an additional protective member as well as a sub base and rivets which have heretofore been required to mount the protective member. Accordingly, it is possible to reduce the number of parts and the number of man-hours needed for the assembling operation and further use the door lock in common to all types of vehicle.

Although the present invention has been described through specific terms, it should be noted here that the described embodiment is not necessarily exclusive and various changes and modifications may be imparted thereto without departing from the scope of the invention which is limited solely by the appended claim.

What is claimed is:

1. A door lock having an open lever linked with an open rod and pivotally mounted on a base plate and a locking lever linked with a locking link and pivotally mounted on a sub plate, said open lever and said locking lever being linked with each other through a locking rod so that a door is selectively locked and unlocked by the pivotal motion of said open lever which is caused by the pivotal motion of said locking lever, wherein the improvement comprises a protective wall in the shape of an upright wall which is formed integral with the side surface of said open lever which faces said locking lever.

* * * * *